US011459713B2

(12) United States Patent
Evans et al.

(10) Patent No.: US 11,459,713 B2
(45) Date of Patent: Oct. 4, 2022

(54) ROADSIDE DELINEATOR DEVICE

(71) Applicants: Mark Evans, Cheney, WA (US); Lorri Evans, Cheney, WA (US)

(72) Inventors: Mark Evans, Cheney, WA (US); Lorri Evans, Cheney, WA (US)

( * ) Notice: Subject to any disclaimer, the term of this patent is extended or adjusted under 35 U.S.C. 154(b) by 0 days.

(21) Appl. No.: 17/030,148

(22) Filed: Sep. 23, 2020

(65) Prior Publication Data

US 2022/0267971 A1 Aug. 25, 2022

(51) Int. Cl.
*E01F 9/635* (2016.01)
*E01F 9/608* (2016.01)

(52) U.S. Cl.
CPC ..... *E01F 9/635* (2016.02); *E01F 9/61* (2016.02)

(58) Field of Classification Search
CPC ... E01F 9/61; E01F 9/623; E01F 9/631; E01F 9/635
See application file for complete search history.

(56) References Cited

U.S. PATENT DOCUMENTS

| | | | | |
|---|---|---|---|---|
| 4,596,489 | A * | 6/1986 | Mariol | E01F 9/642 404/9 |
| 4,923,319 | A * | 5/1990 | Dent | E01F 9/635 411/389 |
| 4,926,592 | A * | 5/1990 | Nehls | E01F 9/681 40/607.05 |
| 5,197,819 | A * | 3/1993 | Hughes | E01F 9/692 52/298 |
| 5,452,965 | A * | 9/1995 | Hughes, Sr. | E01F 9/627 404/10 |
| 7,325,999 | B1 * | 2/2008 | Schindler | E01F 9/629 116/63 P |
| 7,938,594 | B1 * | 5/2011 | Schindler | E01F 9/629 404/9 |
| 7,955,023 | B2 * | 6/2011 | Sung | E01F 9/644 404/9 |
| 9,441,336 | B2 * | 9/2016 | Leahy | E01F 9/635 |
| 9,518,365 | B2 * | 12/2016 | Dixon | E01F 9/573 |
| 9,528,231 | B2 * | 12/2016 | Hughes, Jr. | E01F 9/673 |
| 9,580,877 | B2 * | 2/2017 | Shin | E01F 9/629 |

* cited by examiner

*Primary Examiner* — Gary S Hartmann
(74) *Attorney, Agent, or Firm* — Ivan E. Rozek; Savantek Patent Services

(57) ABSTRACT

A roadside delineator device that includes a breakaway shear pin feature that allows the upper portion of the device to break away from the lower portion of the device during a vehicular accident. The upper and lower halves can be reconnected by replacing the broken shear pins.

3 Claims, 13 Drawing Sheets

ROADSIDE DELINEATOR DEVICE

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of roadside delineator devices and more specifically to a roadside delineator that has a breakaway feature.

Roadside delineators are post-like structures used on the side of roads to show drivers where not to drive. Sometimes they are used in areas where snow or other inclement conditions may make it difficult for a driver to determine where the side of the road ends and the shoulder of the road begins. In other cases, they are simply used to alert drivers as to the location of the edge of the road and the beginning of the shoulder next to the road. The current roadside delineators are retained in the ground by a downward facing post and are of a unitary construction so that if a delineator is accidentally hit and broken a road maintenance crew must dig up the damaged delineator and replace it with a new one. This process takes time and money to fully replace the damaged delineator. Therefore, it would be advantageous to have a roadside delineator that is easier and less expensive to repair and replace.

BRIEF SUMMARY OF THE INSTANT INVENTION

The primary object of the invention is to provide a roadside delineator that has a breakaway feature that allows the lower portion of the delineator to remain in the ground and the upper post portion of the delineator to be reused thereby saving the time and money of replacing the entire device.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a roadside delineator that includes a ground post, a lower body, an upper body, two breakaway pins and an upper post. The ground post is placed in the ground along a roadside. The lower body is connected to the ground post. The upper body is connected to the lower body via the breakaway pins. The upper post acts as a roadside delineator and is attached at its base to the upper body. When the upper post is hit by an oncoming vehicle, the breakaway pins snap and leave the ground post and lower body intact, the upper body and upper post to be reused. The only items needing replacement are the breakaway pins.

BRIEF DESCRIPTION OF THE DRAWINGS

The drawings constitute a part of this specification and include exemplary embodiments to the instant invention, which may be embodied in various forms. It is to be understood that in some instances various aspects of the instant embodiments may be shown exaggerated or enlarged to facilitate an understanding of the instant embodiment.

DETAILED DESCRIPTION OF THE PREFERRED EMBODIMENTS

Figure 1:
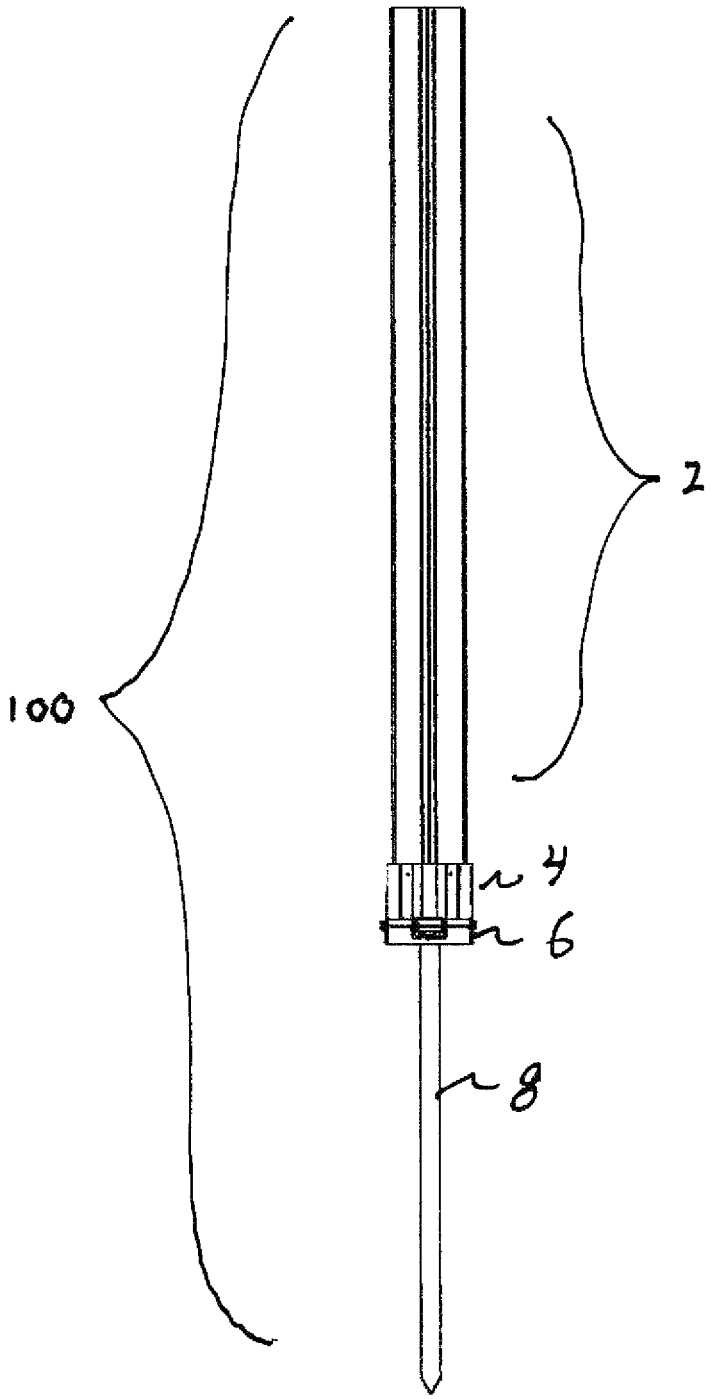
FIG. 1 is a front view of the entire roadside delineator device invention.

Referring now to FIG. 1 we see a front view of the entire roadside delineator device of the present invention 100. A lower post 8 is designed to be sunk into the ground. A lower body 6 is attached to the post 8. An upper body 4 is removably attached to the lower body as will be described in detail below. The upper post 2 is usually used to show drivers where the edge of the road is as it meets the shoulder of the road, a bicycle lane part of the roadway, or a pedestrians only part of the roadway. However other uses may be found such as creating a barrier to an item that should be avoided by a vehicle so that the vehicle will not hit the item.

Figure 2:
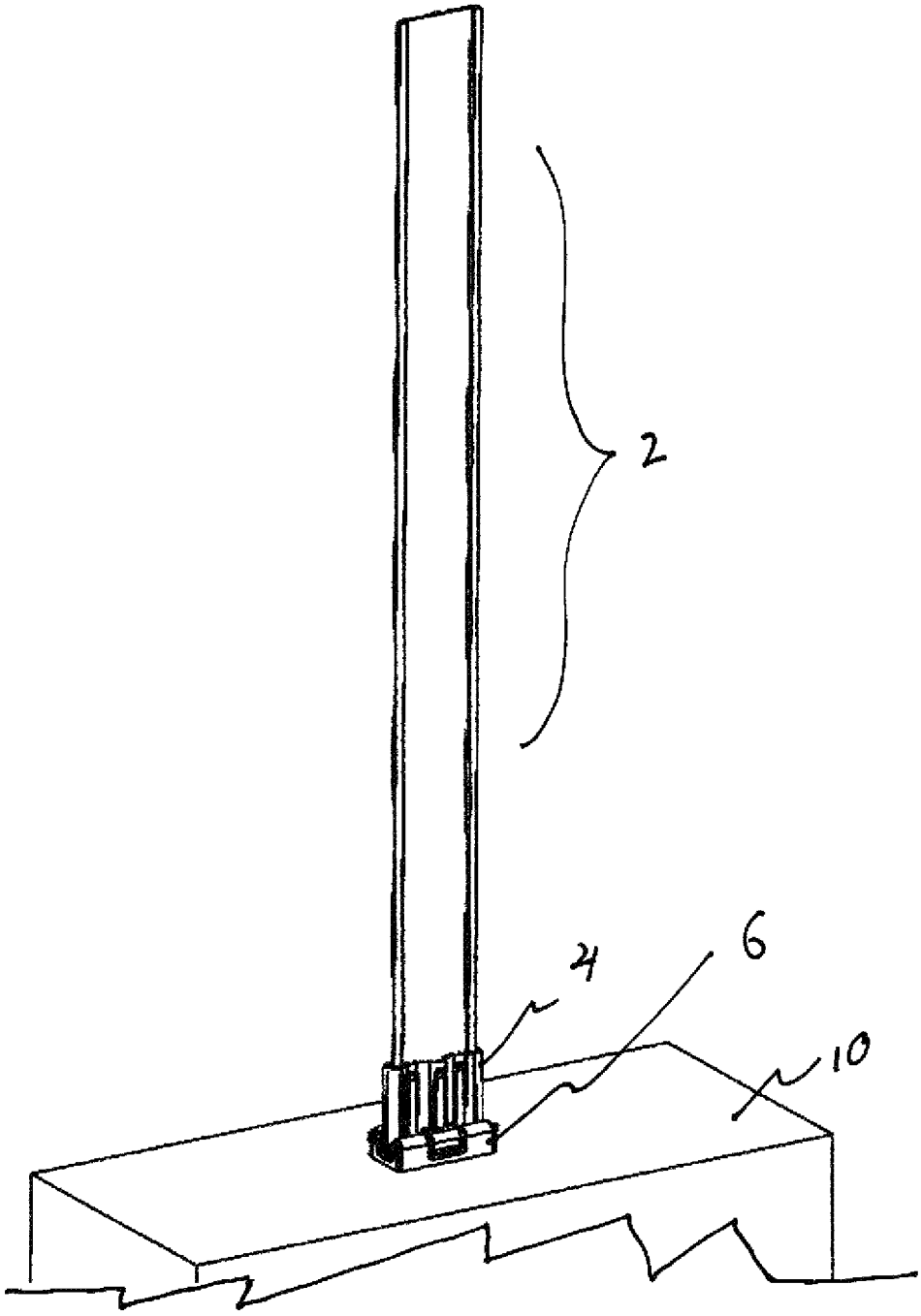
FIG. 2 is a perspective view of the roadside delineator device mounted in a hard substrate.

FIG. 2 is a perspective view of the invention 100 as it is installed into a hard-flat substrate 10 such as packed dirt or concrete.

Figure 3:
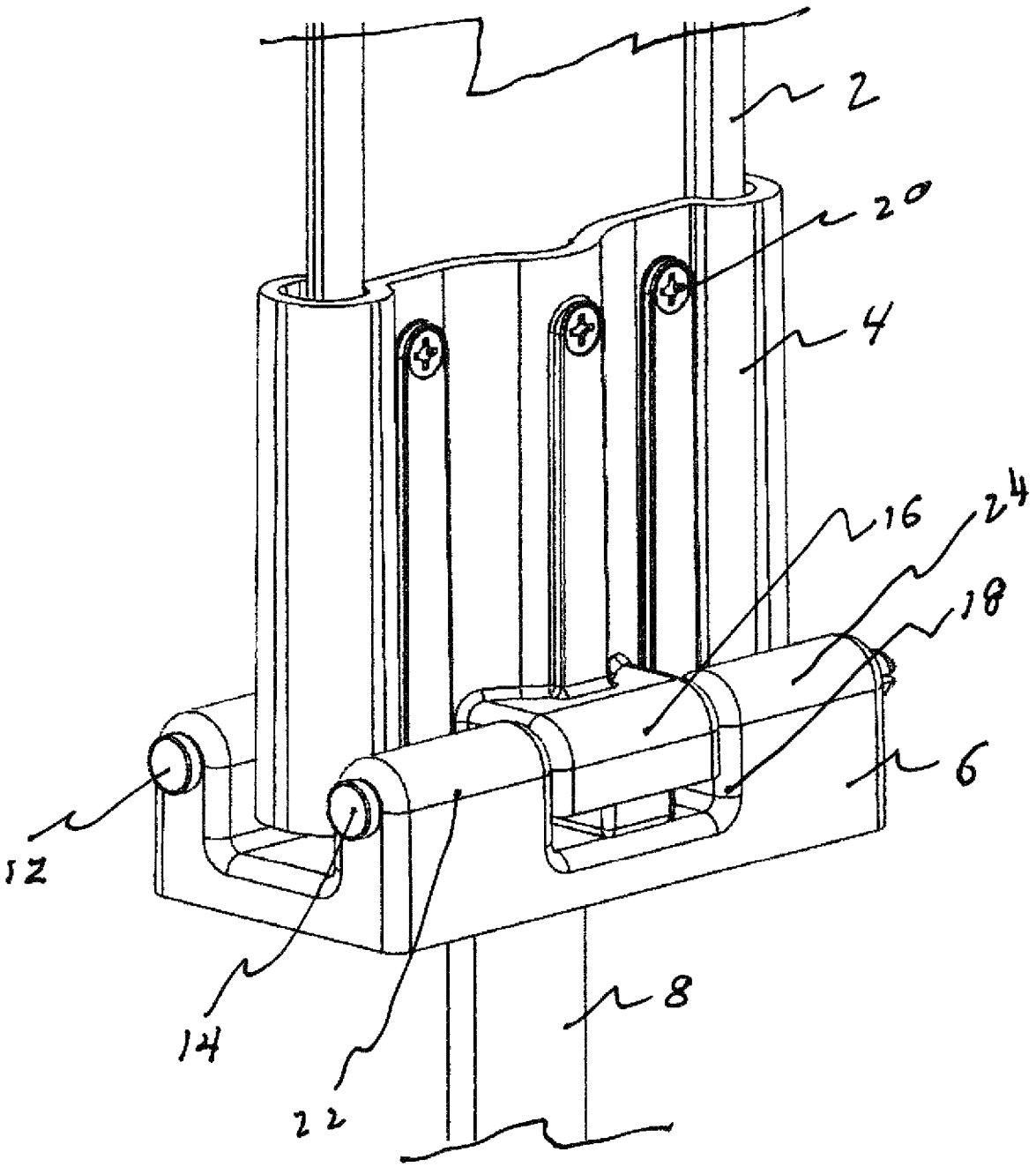
FIG. 3 is a partial perspective view of the invention.

FIG. 3 is a partial perspective view clearly showing the lower body 6 and its relation to the hollow upper body 4. The upper body is held to the lower body by shear pins 12, 14 as they travel through buttress-like portions 22, 16, 24. The upper post 2 is fixedly attached to the upper body 4 via screws 20.

Figure 4:
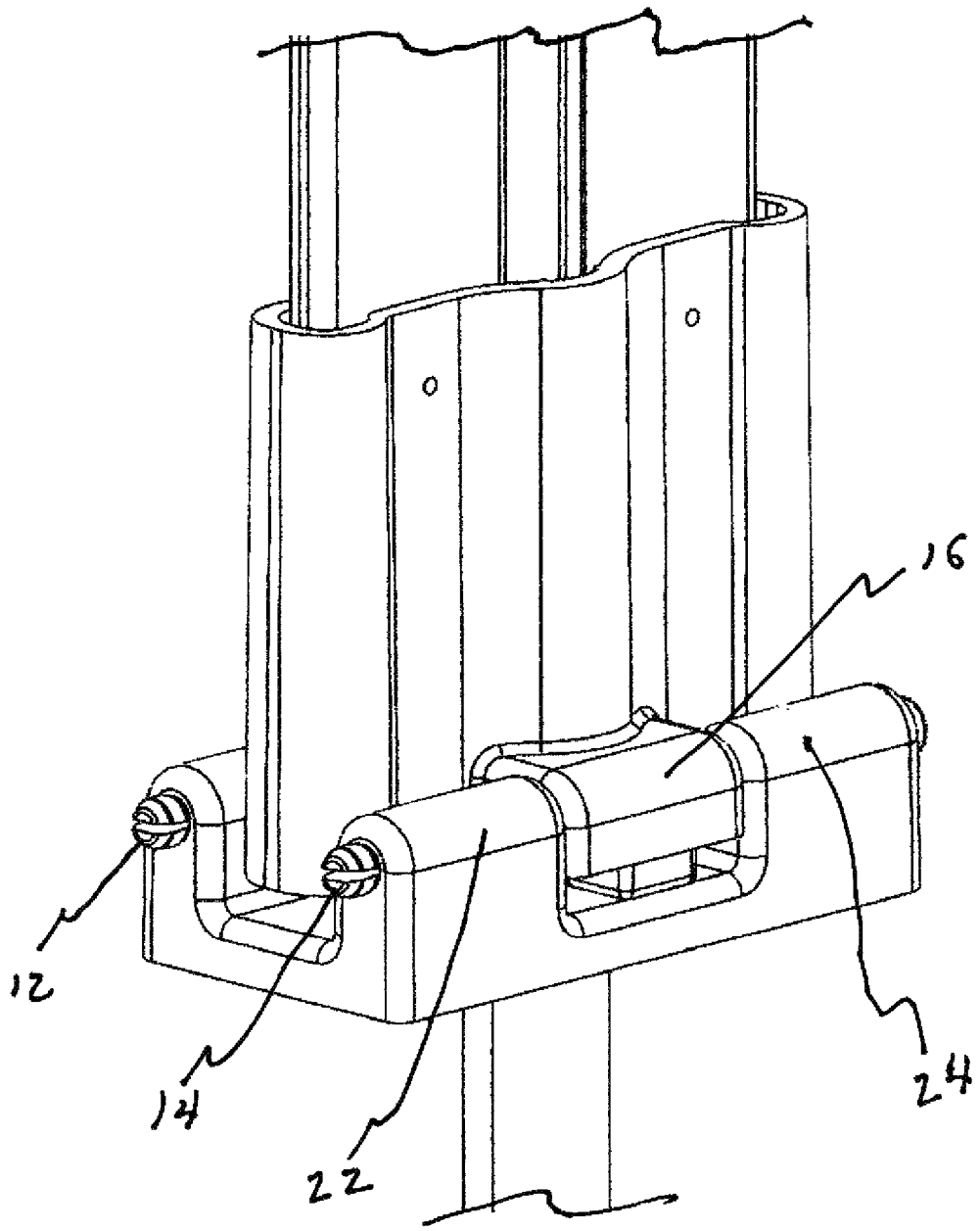
FIG. 4 is a partial perspective view of the invention with the breakaway pins partially removed.
Figure 13:
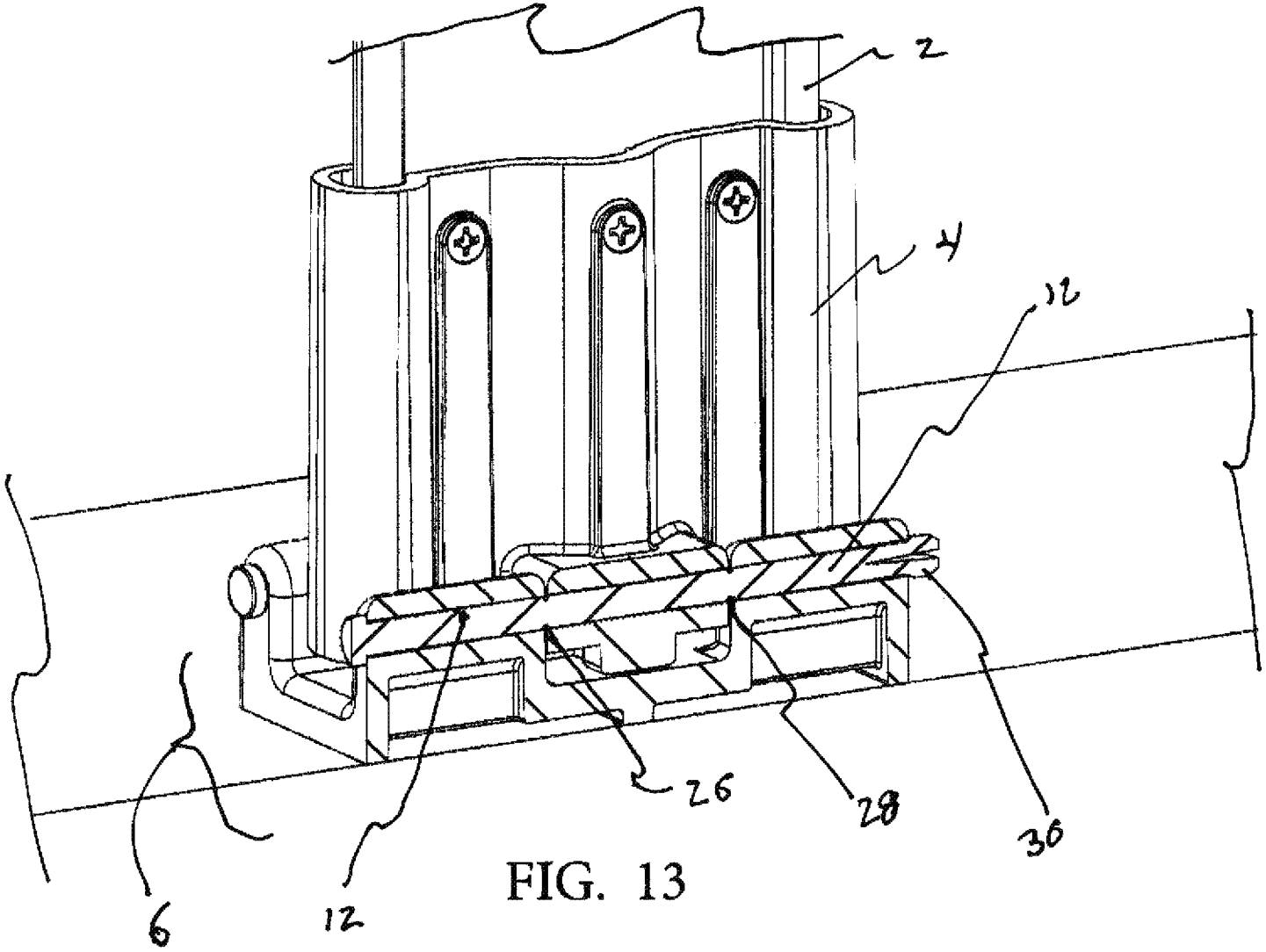
FIG. 13 is a side section view of the lower body.

FIG. 4 is a partial perspective view showing the ends of pins 12, 14 as split and expanded to prevent them from sliding out of their apertures. The split ends of pins 12, 14 are referred to as number 30 in FIGS. 9, 11 and 13. A head on the opposite side of each pin 12, 14 prevents the pins 12, 14 from sliding in the opposite direction.

Figure 5:
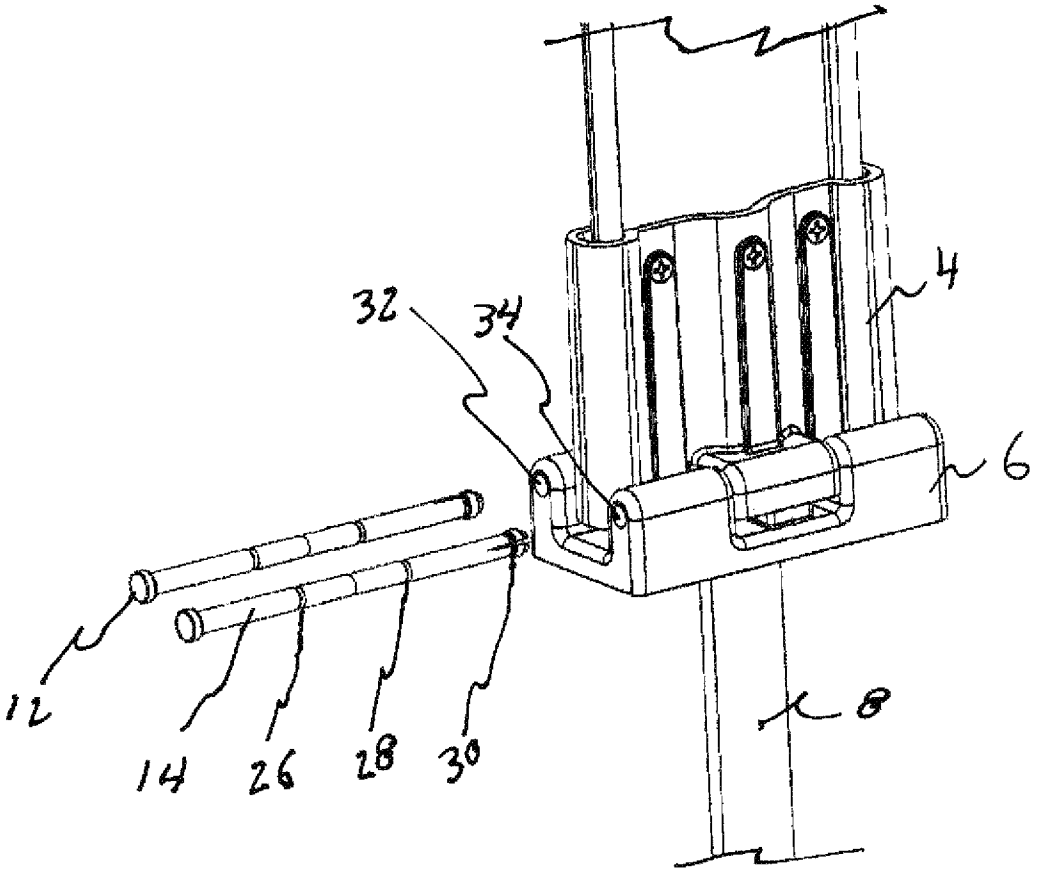
FIG. 5 is a partial perspective view of the invention with the breakaway pins completely removed.

FIG. 5 is a partial perspective view showing the pins 12 completely removed from apertures 32, 34 of upper body 4. The pins have dual V-shaped groove shear points 26, 28 so that when a vehicle hits the upper post 8 the upper body 4 can break away from the lower body 6. The breakaway pins, otherwise known as shear pins 12, 14 are preferably made from fifty percent glass filled nylon. However other materials may be used. Because the lower 6 body and lower post 8 remain intact, the only items that need to be are the shear pins 12, 14. The lower body 6 and upper body 4 and upper post 8 should be in usable condition. In the worst case, the upper body 4 and upper post 8 can be replaced, but the lower body 6 and lower post 8 can remain in place thereby saving time and money that would be needed to replace parts 6 and 8.

Figure 6:
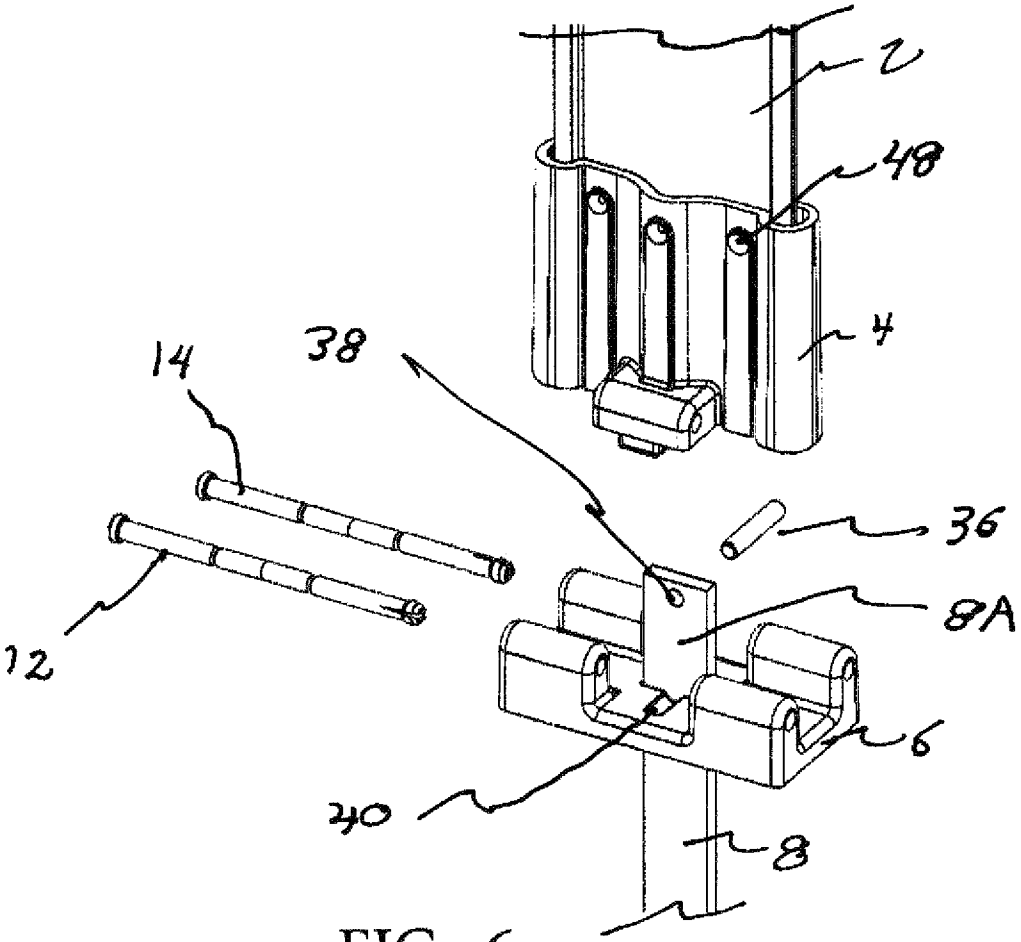
FIG. 6 is an exploded view of the invention.

FIG. 6 is an exploded view of the invention 100 depicting a lower body longitudinal U-shaped channel and a lower body crosswise U-shaped channel created by the buttress-like corners. Cross pin 36 penetrates aperture 38 in top portion 8A of lower post 8 which secures the lower post 8 and lower body 6 to upper body 4 and upper post 2. Apertures 48 align with apertures 52 as shown in FIG. 8 and are all attached by screws 20 as shown in FIG. 3. The cross pin 36 rests in depression 40 and a similar depression 42 as shown in FIG. 7.

Figure 7:
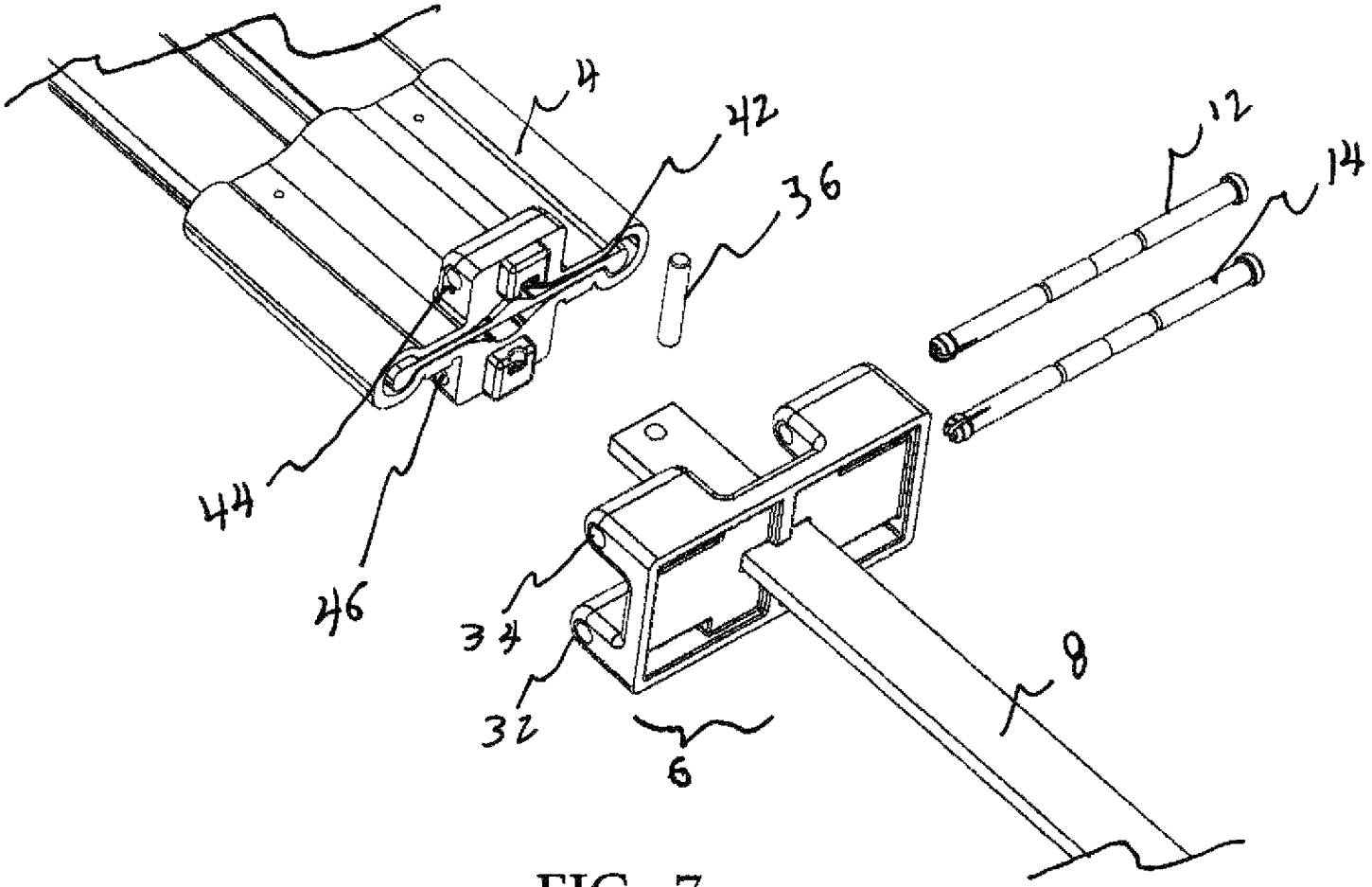
FIG. 7 is a second exploded view of the invention.
Figure 8:
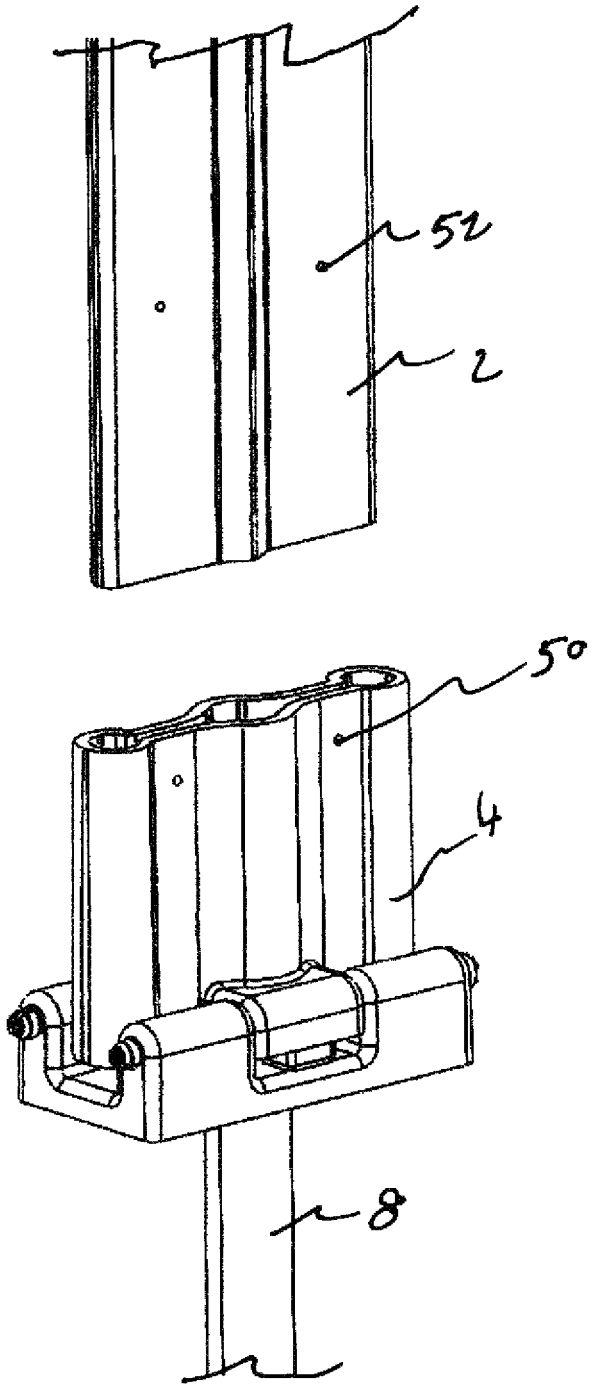
FIG. 8 is an exploded view showing the upper post about to be inserted into the middle body.

FIG. 7 is a perspective view showing the underside of upper body 4 and lower body 6. When the upper body 4 is placed within the lower body 6, apertures 44 align with apertures 34, and aperture 46 aligns with aperture 32 allowing shear pins 12, 14 to slide into the apertures to hold the upper body 4 together with the lower body 6.

FIG. 8 is an exploded view showing upper post 2 about to be inserted into upper body 4. Apertures 52 and 50 align to allow a screw 20 to fixedly attach the upper body 4 to the upper post 2.

Figure 9:
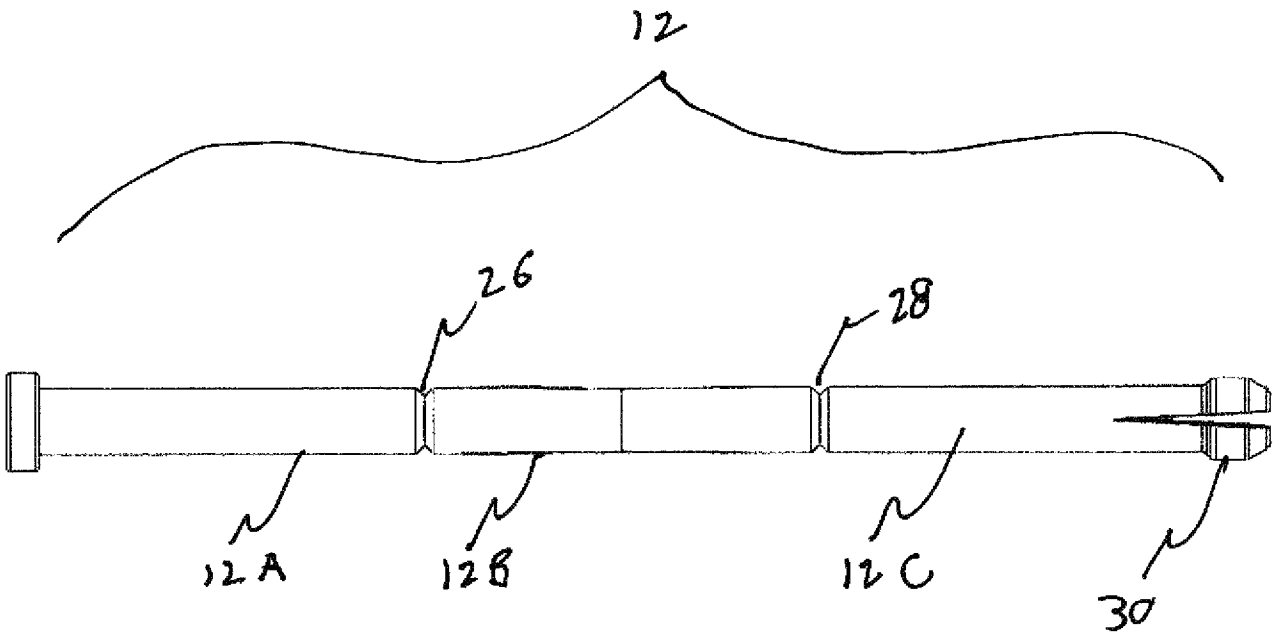
FIG. 9 is a side view of a breakaway pin.

FIG. 9 is a side view of shear pin, or breakaway pin 12. Two V-shaped grooves 26, 28 split the pin roughly in thirds. When a vehicle hits the upper post 2 the shear pin breaks at grooves 26, 28 causing the center portion 12B to remain with the lower body 6 and the left and right portions 12A, 12C to remain with the upper body 4. For replacement, a repair person would push out the broken shear pins 12, 14 and replace them with new unbroken pins.

Figure 10:
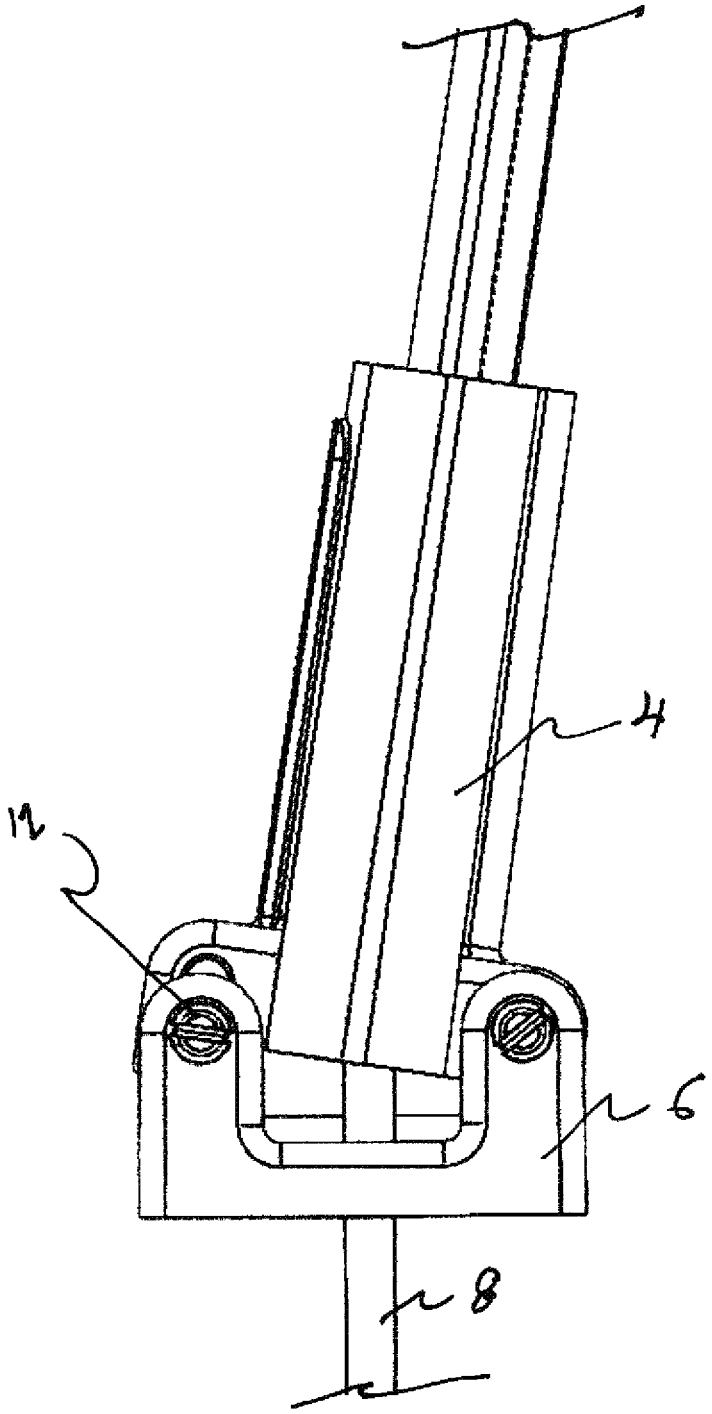
FIG. 10 is a side view of the invention showing the upper body and upper post being pushed to one side after being struck by a vehicle.

FIG. 10 is a partial perspective view showing the upper body 4 after it has been hit causing shear pin 12 to break.

Figure 11:
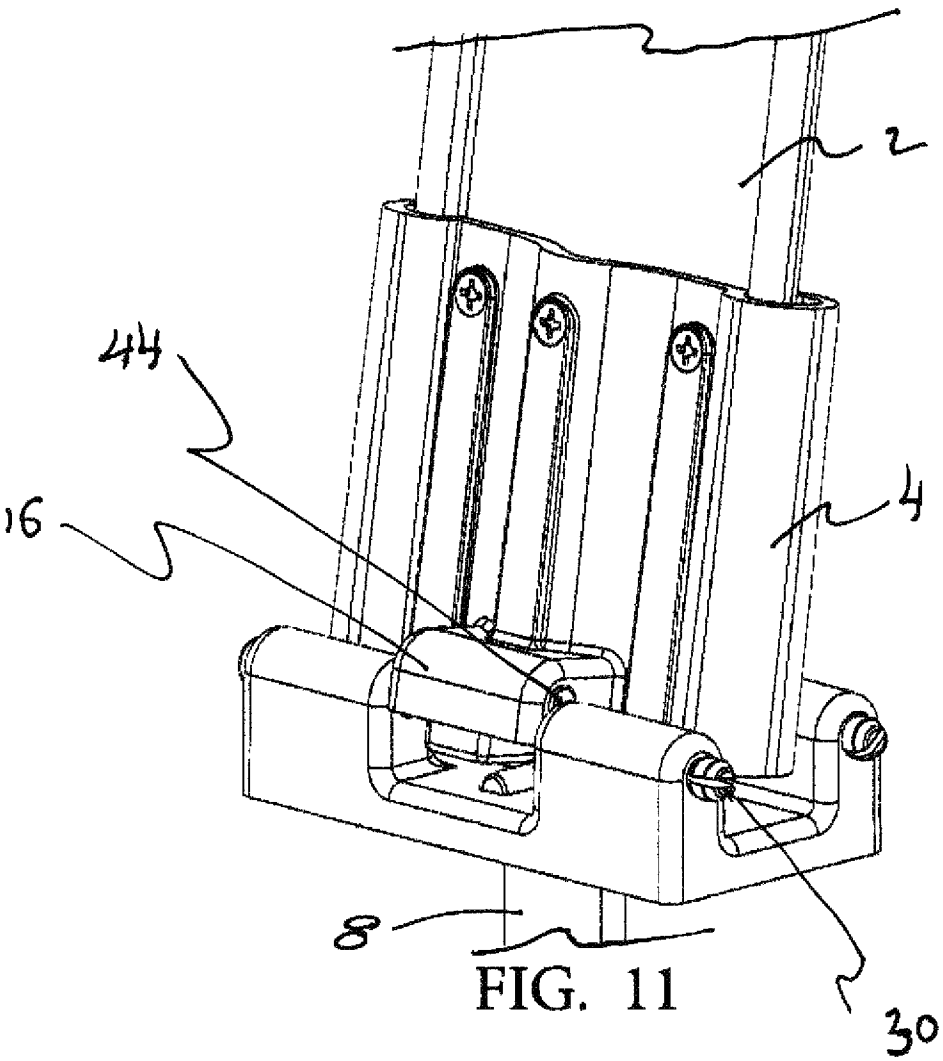
FIG. 11 is a perspective view of the invention showing the upper body and upper post being pushed to one side after being struck by a vehicle.

FIG. 11 is a partial perspective view of the upper body 4 partially lifted to expose the broken end 44 of shear pin 12.

Figure 12:
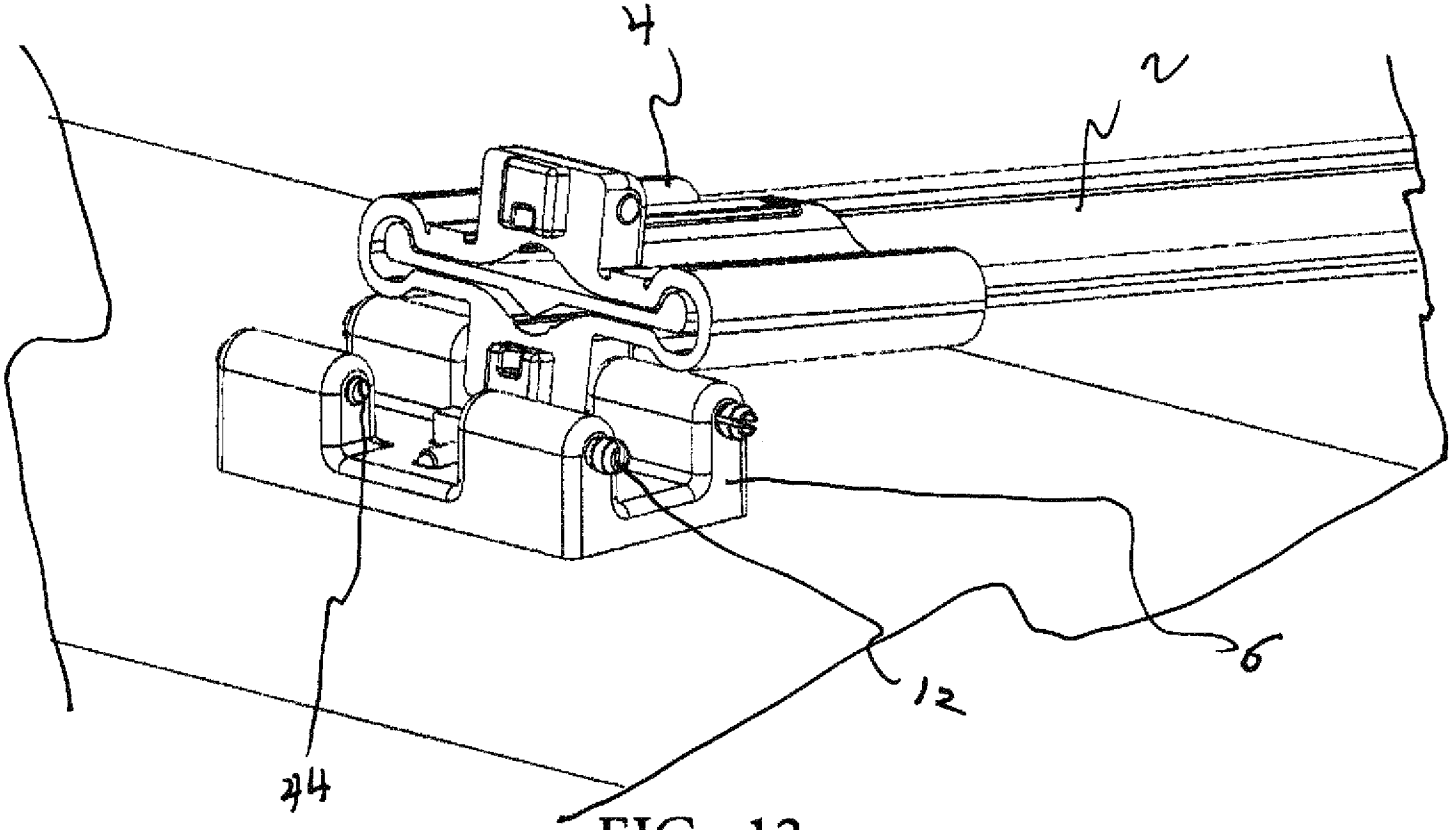
FIG. 12 is a perspective view showing the upper body and upper post being completely pushed over after being stuck by a vehicle.

FIG. 12 is a perspective view showing the upper body 4 completely rotated over after it has been hit exposing the broken end 44 of shear pin 12. When the upper post 2 has been hit, one or both shear pins 12, 14 may become broken. However, the upper body 4 and upper post 2 should remain in usable condition and should be able to be reconnected to lower body 6 by a new pair of shear pins 12, 14.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

Definitions

Inside: The side of a device or of a device component facing vehicular traffic.

Outside: The opposite side of inside, that is the side delineated from traffic.

Longitudinal: Direction parallel to the roadway.

Crosswise: Direction perpendicular to longitudinal.

What is claimed is:

1. A breakaway roadside delineator device comprising:

an upper body fixedly attached to an upper post;

a lower body fixedly attached to a lower post, wherein the lower post is sunk into ground to hold the delineator device in place;

a pair of shear pins, wherein the shear pins include a plurality of V-shaped grooves that act as shear points when the upper post is struck by a vehicle;

the lower body further comprising four buttress-like longitudinal corners, each corner comprising a longitudinal aperture, the apertures being longitudinally aligned, wherein the four buttress-like corners form a longitudinal U-shaped channel and a crosswise U-shaped channel;

the upper body further comprising a hollow longitudinal body attached to the upper post, the upper hollow body shaped to fit into the lower body longitudinal U-shaped channel, the upper body further comprising side portions shaped to fit into the lower body crosswise U-shaped channel, the side portions further comprising longitudinal apertures aligned with the lower body longitudinal apertures;

the upper body removably attached to the lower body by the pair of shear pins inserted and spanning the longitudinally aligned lower and upper body apertures; and whereby when a vehicle hits the upper post, the pair of shear pins breaks causing the upper body and the upper post to separate from the lower body and lower post.

2. The breakaway roadside delineator of claim 1 wherein the shear pins are made of approximately 50% fiberglass.

3. The breakaway roadside delineator of claim 1 wherein the upper post and the upper body can be reattached to the lower body and the lower post by replacing the shear pins with new shear pins.

* * * * *